US012404666B2

(12) United States Patent
Lechner et al.

(10) Patent No.: US 12,404,666 B2
(45) Date of Patent: Sep. 2, 2025

(54) MOUNTING DEVICE

(71) Applicant: Geberit International AG, Jona (CH)

(72) Inventors: Manuel Lechner, Kaltbrunn (CH); Lukas Ramseier, Jona (CH); Mike Schindler, Elterlein (DE)

(73) Assignee: GEBERIT INTERNATIONAL AG, Jona (CH)

( * ) Notice: Subject to any disclaimer, the term of this patent is extended or adjusted under 35 U.S.C. 154(b) by 54 days.

(21) Appl. No.: 18/038,323

(22) PCT Filed: Dec. 1, 2021

(86) PCT No.: PCT/EP2021/083685
§ 371 (c)(1),
(2) Date: May 23, 2023

(87) PCT Pub. No.: WO2022/122493
PCT Pub. Date: Jun. 16, 2022

(65) Prior Publication Data

US 2023/0417033 A1 Dec. 28, 2023

(30) Foreign Application Priority Data

Dec. 10, 2020 (EP) ..... 20213092
Dec. 10, 2020 (EP) ..... 20213096
Dec. 10, 2020 (EP) ..... 20213098

(51) Int. Cl.
*E03C 1/326* (2006.01)
*E03D 11/14* (2006.01)

(52) U.S. Cl.
CPC ..... *E03C 1/326* (2013.01); *E03D 11/143* (2013.01)

(58) Field of Classification Search
CPC ..... E03C 1/326; E03D 11/143
(Continued)

(56) References Cited

U.S. PATENT DOCUMENTS 11,746,947 B2 * 9/2023 Yamada ..... F16M 11/041 248/127
2008/0054131 A1 * 3/2008 Joy ..... F16M 11/041 248/127

(Continued)

FOREIGN PATENT DOCUMENTS

DE 26 39 018 A1 3/1978
DE 2 809 135 A1 9/1979

(Continued)

OTHER PUBLICATIONS

International Search Report for PCT/EP2021/083684 dated Mar. 14, 2022.

(Continued)

*Primary Examiner* — Lori L Baker
(74) *Attorney, Agent, or Firm* — Sughrue Mion, PLLC

(57) ABSTRACT

A mounting device for fastening at least one sanitary item having two supports which extend at a distance from each other along a central axis, and a crossbeam-element which is placed between the supports, connects the two supports and includes at least one fastening element, the crossbeam-element being formed by a front supporting piece with a supporting wall on which a sanitary item can be supported, and a rear supporting piece with a rear wall, the front supporting piece and/or the rear supporting piece being provided with at least one connection flange which projects at a right angle from the supporting wall and/or from the rear wall and which allows the two supporting pieces to be fixedly connected to one another such that in the connected state, the supporting wall is at a distance from the rear wall.

18 Claims, 6 Drawing Sheets

(58) Field of Classification Search
USPC ..... 4/643, 619, 252.1, 516, 592, 630–631
See application file for complete search history.

(56) References Cited

U.S. PATENT DOCUMENTS

| | | | | |
|---|---|---|---|---|
| 2010/0044541 | A1* | 2/2010 | Sapper ..... | F16M 11/24 248/371 |
| 2012/0028068 | A1* | 2/2012 | Sedlmaier ..... | B21D 7/028 428/577 |

FOREIGN PATENT DOCUMENTS

| | | | |
|---|---|---|---|
| DE | 3410499 | A1 | 8/1985 |
| DE | 297 04 549 | U1 | 4/1997 |
| DE | 203 04 749 | U1 | 5/2003 |
| DE | 102013203941 | A1 | 9/2014 |
| EP | 0 731 231 | A1 | 9/1996 |
| EP | 0731224 | A1 | 9/1996 |
| EP | 0898023 | A2 | 2/1999 |
| EP | 2110483 | A1 | 10/2009 |
| EP | 2 366 838 | A1 | 9/2011 |
| EP | 2 662 502 | A1 | 11/2013 |
| EP | 2 921 719 | A1 | 9/2015 |
| EP | 3 470 587 | A1 | 4/2019 |
| EP | 3 670 772 | A1 | 6/2020 |
| RU | 21790 | U1 | 2/2002 |
| WO | 2015/180962 | A1 | 12/2015 |

OTHER PUBLICATIONS

Written Opinion for PCT/EP2021/083684 dated Mar. 14, 2022.
International Search Report for PCT/EP2021/083683 dated Mar. 18, 2022.
Written Opinion for PCT/EP2021/083683 dated Mar. 18, 2022.
Written Opinion for PCT/EP2021/083685 dated Mar. 14, 2022.
International Search Report of PCT/EP2021/083685 dated Mar. 14, 2022 [PCT/ISA/210].

* cited by examiner

MOUNTING DEVICE

CROSS REFERENCE TO RELATED APPLICATIONS

This application is a National Stage of International Application No. PCT/EP2021/083685 filed on Dec. 1, 2021, claiming priority based on European Patent Application No. 20213098.5 filed on Dec. 10, 2020, European Patent Application No. 20213096.9 filed on Dec. 10, 2020, and European Patent Application No. 20213092.8 filed on Dec. 10, 2020.

TECHNICAL FIELD

The present invention relates to a mounting device for fastening at least one sanitary item, according to the preamble of claim 1.

PRIOR ART

Mounting devices for fastening sanitary items are known from the prior art. Mounting devices of this type are fixedly installed behind a front wall and serve for mounting sanitary items such as cisterns, toilet bowls, urinals, fittings, washbasins, control elements, electrical elements, etc. Such a mounting device is disclosed in EP 2 662 502, for example.

A further mounting device which has a support element that supports the crossbeam is disclosed in EP 3 071 757.

A further mounting device in which a support is connected to a hollow member, the latter having a supporting effect for the support, on the one hand, and providing a contact face for the sanitary unit fastened to the support, on the other hand, is disclosed in EP 3 149 251.

While very positive results are achieved when using the mounting devices from the prior art during assembling in a building, from the point of view of a manufacturer it is desirable for the production to be simplified. Many of the known mounting devices are very complex in terms of production.

SUMMARY OF THE INVENTION

Proceeding from this prior art, the invention is based on an object of specifying a mounting device for the fastening of at least one sanitary item which overcomes the disadvantages of the prior art. It is in particular an object of the present invention to specify a mounting device for the fastening of at least one sanitary item which can be produced in a simpler and/or more efficient manner. This in particular while maintaining a high level of stability for the mounting device.

This object is achieved by a mounting device for the fastening of at least one sanitary item, as claimed in claim 1. Accordingly, the mounting device comprises two supports which run so as to be mutually spaced apart and extend in each case along a central axis, and a crossbeam element which has at least one fastening element, is disposed between the supports and connects the two supports. The crossbeam element is provided by a front support part having a support wall on which a sanitary item is able to be supported, and by a rear support part having a rear wall. The front support part and/or the rear support part have/has at least one connection lug which projects from the support wall and/or from the rear wall so as to be inclined at an angle, in particular orthogonally. The two support parts by way of the at least one connection lug are able to be fixedly connected to one another in such a manner that in the connected state the support wall is spaced apart from the rear wall.

As a result of connection lugs being disposed on the two support parts, the advantage that the crossbeam element can be produced in a very simple manner is derived. In particular, complex alignment works are dispensed with, because the two support parts can be positioned relative to one another by the connection lugs and then are able to be connected to one another by way of the connection lugs.

The term "able to be fixedly connected" is understood to mean a connection which is mechanically fixed. A connection of this type can be established by way of a materially integral and/or form-fitting and/or force-fitting connection. The connection is particularly preferably a welded connection.

As a result of the spacing of the support wall from the rear wall, the advantage that the crossbeam element can be provided as a hollow member is derived, as a result of which a high level of mechanical stability can be achieved.

The at least one fastening element can be configured in different ways. For example as a threaded opening directly in the crossbeam element, as openings in the crossbeam element, as nuts behind an opening in the crossbeam element, or as a separate fastening part behind an opening in the crossbeam element. A threaded bar is preferably able to be connected to the at least one fastening element. This means that the at least one fastening element is a receptacle for a threaded bar, for example. Said fastening part is preferably fixedly connected to the crossbeam element and preferably lies behind the front web.

The at least one connection lug of the front support part preferably comes into planar contact with the at least one connection lug of the rear support part. In the connected state, the connection lugs of the front support part and of the rear support part are in mutual planar contact.

As a result of the planar contact between the two connection lugs, the advantage of exact positioning of the two support parts relative to one another is derived. Moreover, a support effect between the two support parts is derived by way of the planar contact. Furthermore, said fixed connection can be placed in the region of the planar contact.

In one variant, the at least one connection lug of the one support part is preferably configured so as to be shorter than the at least one connection lug of the other support part. At least one weld is provided on the frontal end of the shorter connection lug and the surface of the longer connection lug. Space for a weld is achieved as a result of the one connection lug being of a shorter configuration. In particular, the weld comes to lie in the region of the surface of the longer connection lug, as a result of which the advantage that the weld comes to lie at a location which is very suitable for a weld is derived.

In another variant, the at least one connection lug of the one support part is preferably configured so as to have the same length as the at least one connection lug of the other support part. At least one weld is provided on the frontal end of the one connection lug and the surface of the other connection lug. In a configuration of the connection lugs of identical length, the welded connection likewise comes to lie on the surface of the other connection lug.

The support wall, the rear wall, the connection lugs and the supports preferably define a hollow member having a cavity, wherein said weld lies outside the cavity.

This results in a good accessibility for producing the weld. In particular, said shorter connection lug in the connected state lies outside the cavity.

The at least one connection lug from the front support part preferably impacts the internal face of the rear support part that faces the front support part, as a result of which the spacing between the front support part and the rear support part is defined. Alternatively or similarly, the at least one connection lug from the rear support part impacts the internal face of the front support part that faces the rear support part, as a result of which the spacing between the front support part and the rear support part is defined.

As a result of the connection lugs impacting the corresponding internal face the advantage is derived that no additional elements which define the spacing between the two support parts are to be provided. To this extent, the production, or the mounting, of the crossbeam element is highly simplified.

The front support part is preferably configured so as to be integral to the support wall and the at least one connection lug. Likewise, the rear support part is configured so as to be integral to the rear wall and the connection lug.

The two support parts are preferably produced from a metal sheet, wherein the connection lugs are bent away from the support wall or the rear wall, respectively. Prior to the bending procedure, the metal sheet is cut to the required shape and size by a blanking procedure or a stamping procedure.

The crossbeam element preferably comprises a clearance which provides a vacant intermediate space extending through the crossbeam element, a waste pipe being able to be routed through said intermediate space, wherein the clearance in the support parts is formed by a cut-out in the support wall and the rear wall.

The clearance preferably extends into the crossbeam element from below, and is configured so as to be open toward the bottom. The clearance may have different shapes. The clearance is particularly preferably rectangular. Other shapes such as V-shaped or trapezoidal, for example, are also conceivable. The clearance particularly preferably has straight lateral edges such that a connection lug can be bent away from the support wall or the rear wall, respectively.

Connection lugs preferably extend in each case along the lateral edges which are mutually opposite in terms of the cut-out, and further connection lugs extend along the lateral edges which extend from the cut-out to the support.

The connection lugs preferably extend in each case along the entire length of the respective lateral edge from which said connection lugs project.

A reinforcement portion preferably adjoins the support wall and/or the rear wall on the upper side in the installed position.

As a result of the reinforcement portions the advantage that the stability of the crossbeam element can be further increased is derived.

The reinforcement portion disposed on the support wall is preferably configured as a bending lug which preferably has an optional interruption for the feedthrough of connecting lines. The reinforcement portion disposed on the rear wall is preferably configured as a bending lug which preferably extends completely between the crossbeams.

The bending lugs on the end side preferably have a reinforcement fin. As a result, the corresponding portion can be mechanically reinforced in particular in relation to bending stress.

The reinforcement portion of the support wall in the connected state is preferably spaced apart from the reinforcement portion of the rear wall such that an installation space for receiving fastening elements is achieved between the reinforcement portions.

The support wall and the rear wall by way of the lateral edges thereof that face the support are preferably connected to the respective support, wherein the connection lugs run along free lateral edges that are not connected to the support.

The connection lugs are preferably connected to one another by a welded connection. The crossbeam element is preferably made of metal and connected to the support in a materially integral manner, in particular by way of a welded connection, and/or in a form-fitting or force-fitting manner, respectively. Alternatively, the crossbeam element is made of plastics material and is connected to the supports in a form-fitting and/or force-fitting manner.

The support portion in terms of the at least one fastening element preferably extends substantially toward the bottom in the installed position.

The maximum extent of the crossbeam element, when viewed in the direction of the longitudinal axis of the supports, is preferably in the range from 150 mm to 500 mm, in particular in the range from 200 mm to 400 mm, the extent particularly preferably being between 275 mm and 350 mm.

The front faces of the supports preferably define a front plane, and the rear faces of the supports define a rear plane, wherein the crossbeam element lies between these two planes or is congruent with these planes.

At least one, in particular each, of the supports is preferably connected to a support foot, the mounting device by way of this support foot standing on a floor, wherein the support foot is preferably configured so as to be displaceable relative to the support and lockable in relation to the support.

A method for producing a mounting device according to the above description is characterized in that, in a first step, the two support parts and the two supports are provided;

in that, in a subsequent step, the two support parts are connected to one another by way of the connection lugs and to the supports.

All welded connections are preferably provided either from the rear side or from the front side. The advantage that the mounting device does not have to be turned during production is derived as a result.

An arrangement comprises a mounting device according to the above description and a sanitary item assembled on the mounting device, said sanitary item having a support face, wherein the support face of the sanitary item superimposes parts of the support wall of the front support part.

Further embodiments of the invention are laid down in the dependent claims.

BRIEF DESCRIPTION OF THE DRAWINGS

Preferred embodiments of the invention are described in the following with reference to the drawings, which are for the purpose of illustrating the present preferred embodiments of the invention and not for the purpose of limiting the same. In the drawings.

DESCRIPTION OF PREFERRED EMBODIMENTS

Figure 1:
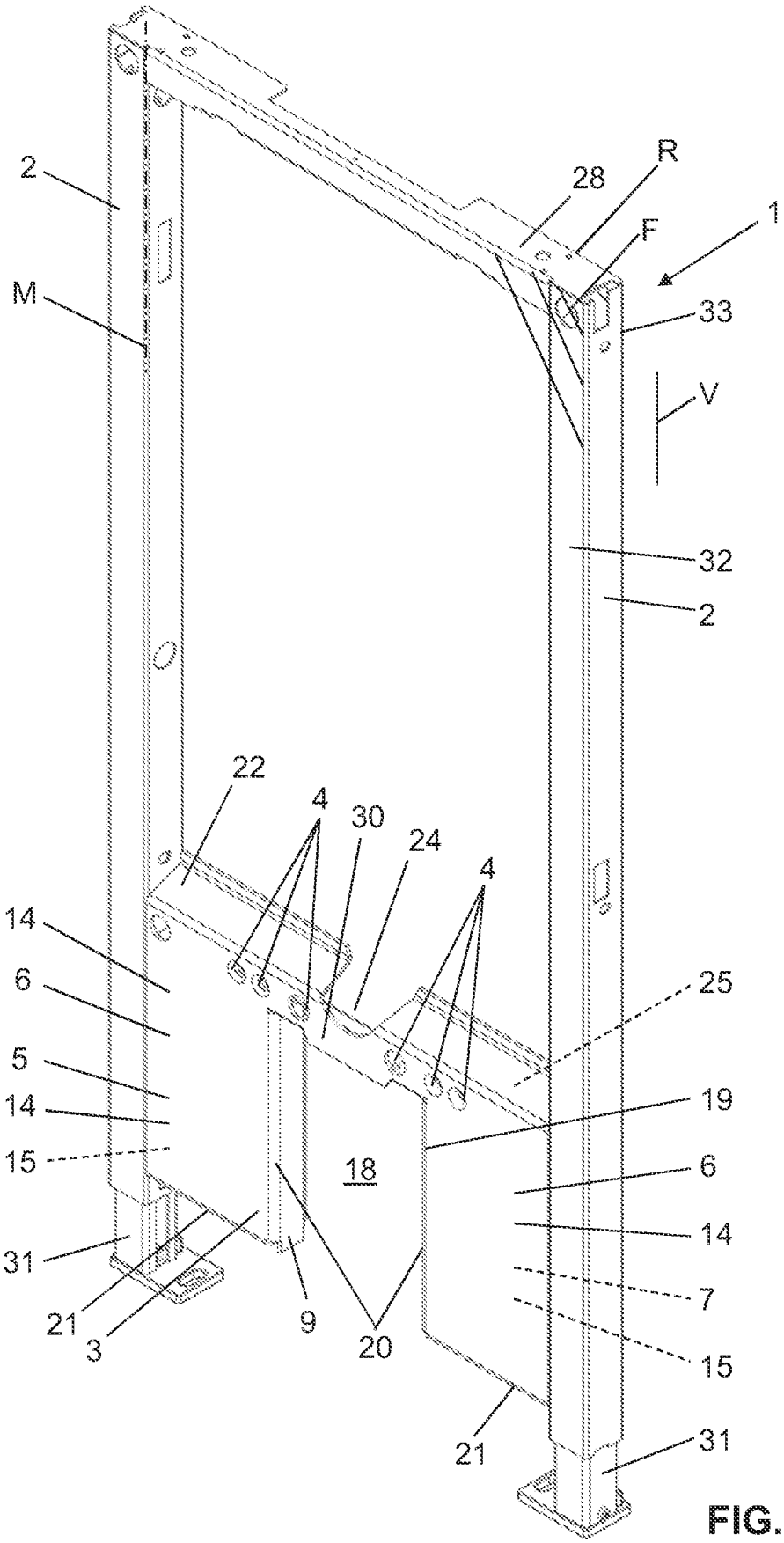
FIG. 1 shows a perspective view of a mounting device according to the present invention from the front.

Shown in the figures is a mounting device 1 for the fastening of at least one sanitary item. The mounting device 1 in the embodiment shown comprises two supports 2 which run so as to be mutually spaced apart and extend in each case along a central axis M, and a crossbeam element 3 which has at least one fastening element 4, is disposed between the supports 2 and connects the two supports 2. The sanitary item is fastened to and supported on the crossbeam element 3.

In the embodiment shown, a plurality of fastening elements 4 are disposed next to one another. A sanitary item can be fastened to the mounting device 1 by way of these fastening elements 4. In the installed position, the two supports 2 typically run in the vertical V, that is to say in the direction of the plumb line. The two supports 2 on the upper side are connected to a crossbeam 28.

Figure 2:
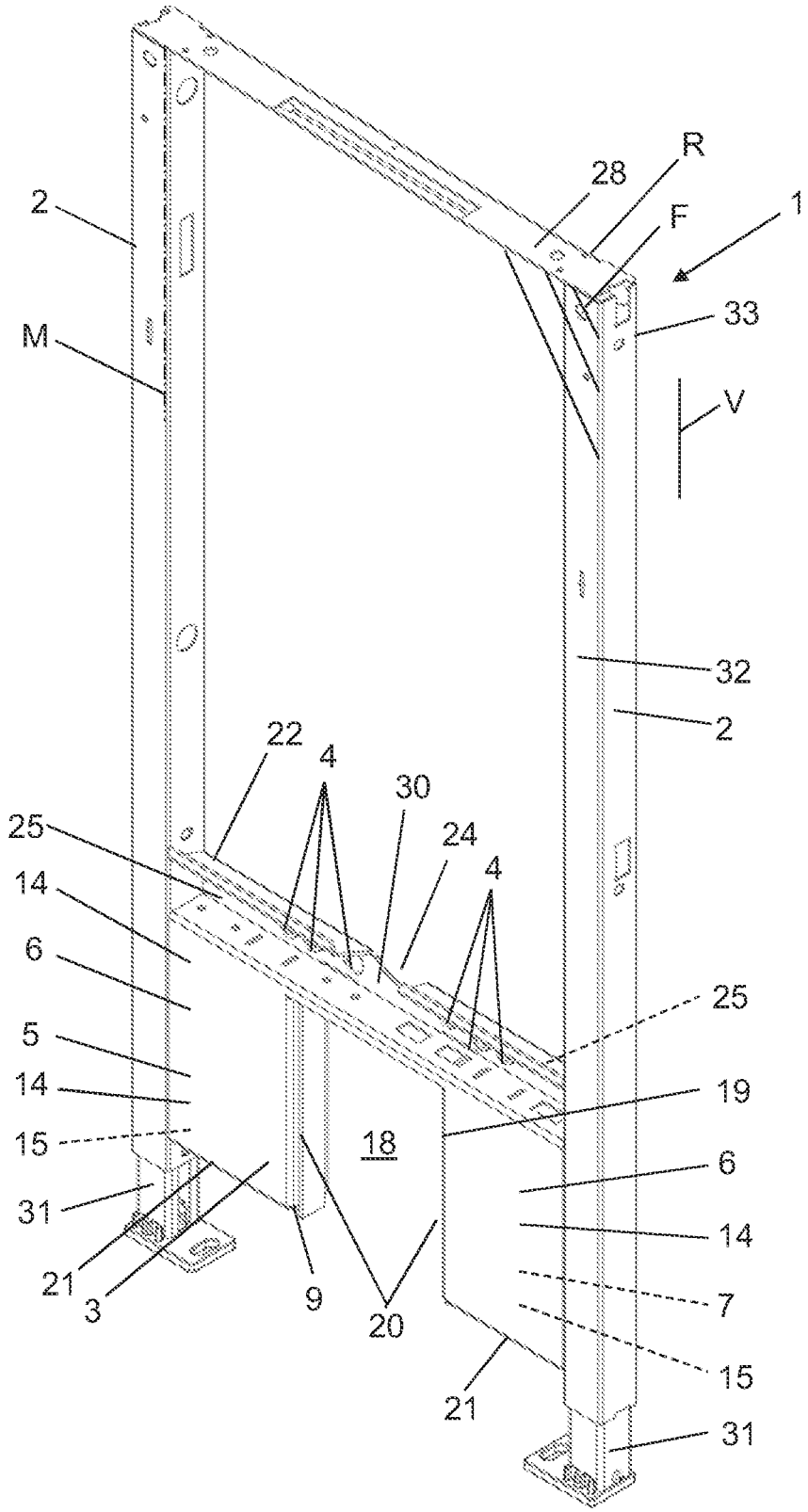
FIG. 2 shows a perspective view of the mounting device according to FIG. 1 from the rear.
Figure 3:
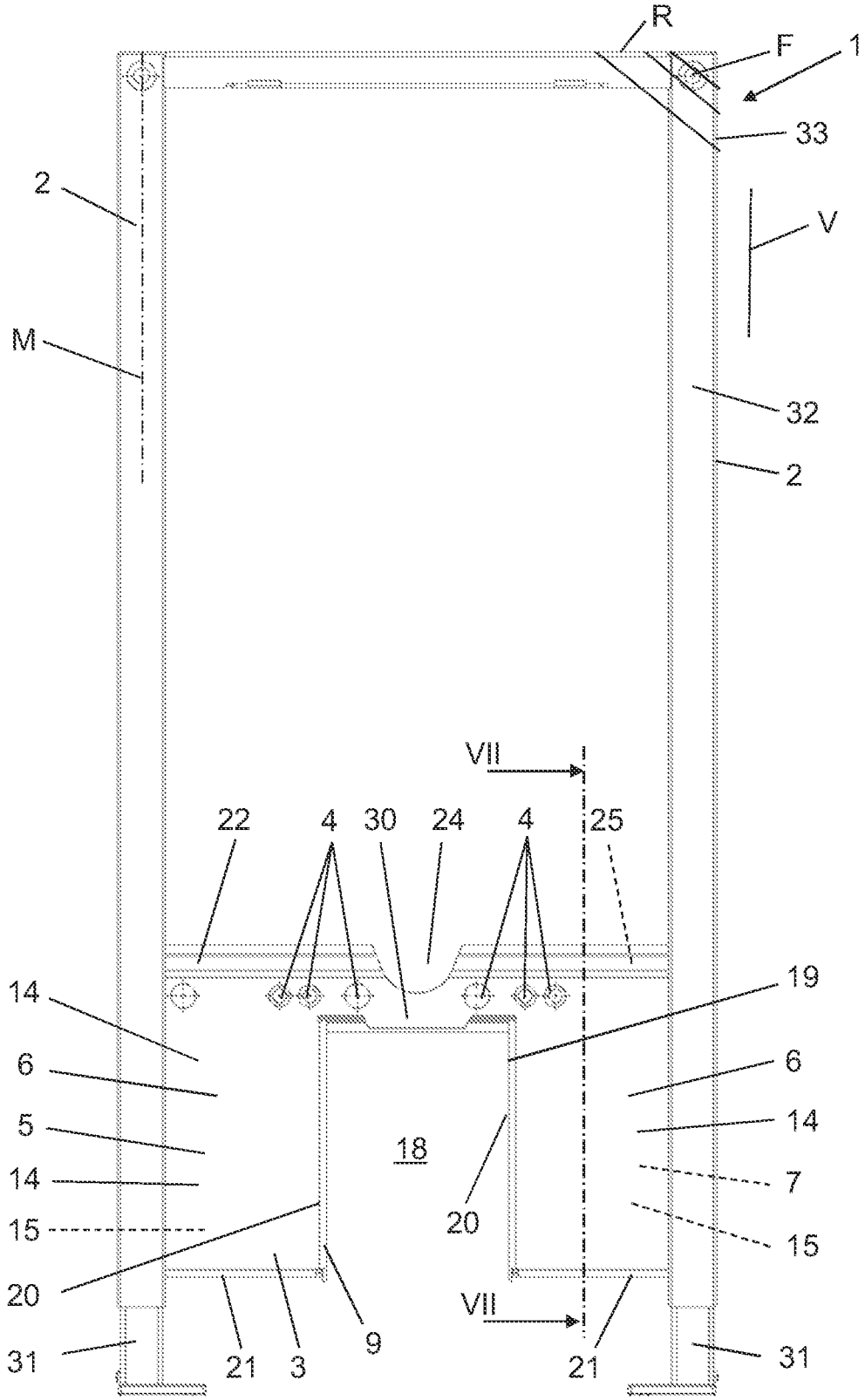
FIG. 3 shows a front view of the mounting device according to FIG. 1 from the front.

FIGS. 1 and 2 show the mounting device in a perspective view from the front and from the rear. A view from the front is shown in FIG. 3. The crossbeam element 3 in the embodiment shown has a clearance 18 through which a waste pipe can be routed, for example. The width of the clearance 18, viewed transversely to the central axis M of the supports 2, in the example shown corresponds to approximately one third of the entire width of the crossbeam element 3. The crossbeam element 3, and the front support part 5 and the rear support part 7, respectively, extend to the left and the right of the clearance 18. In other words, the clearance 18 from a region below and opposite the at least one fastening element 4 extends into the crossbeam element 3. When viewed in the installed position, the clearance 18 extends into the crossbeam element 3 from below, and is configured so as to be open toward the bottom.

Figure 4:
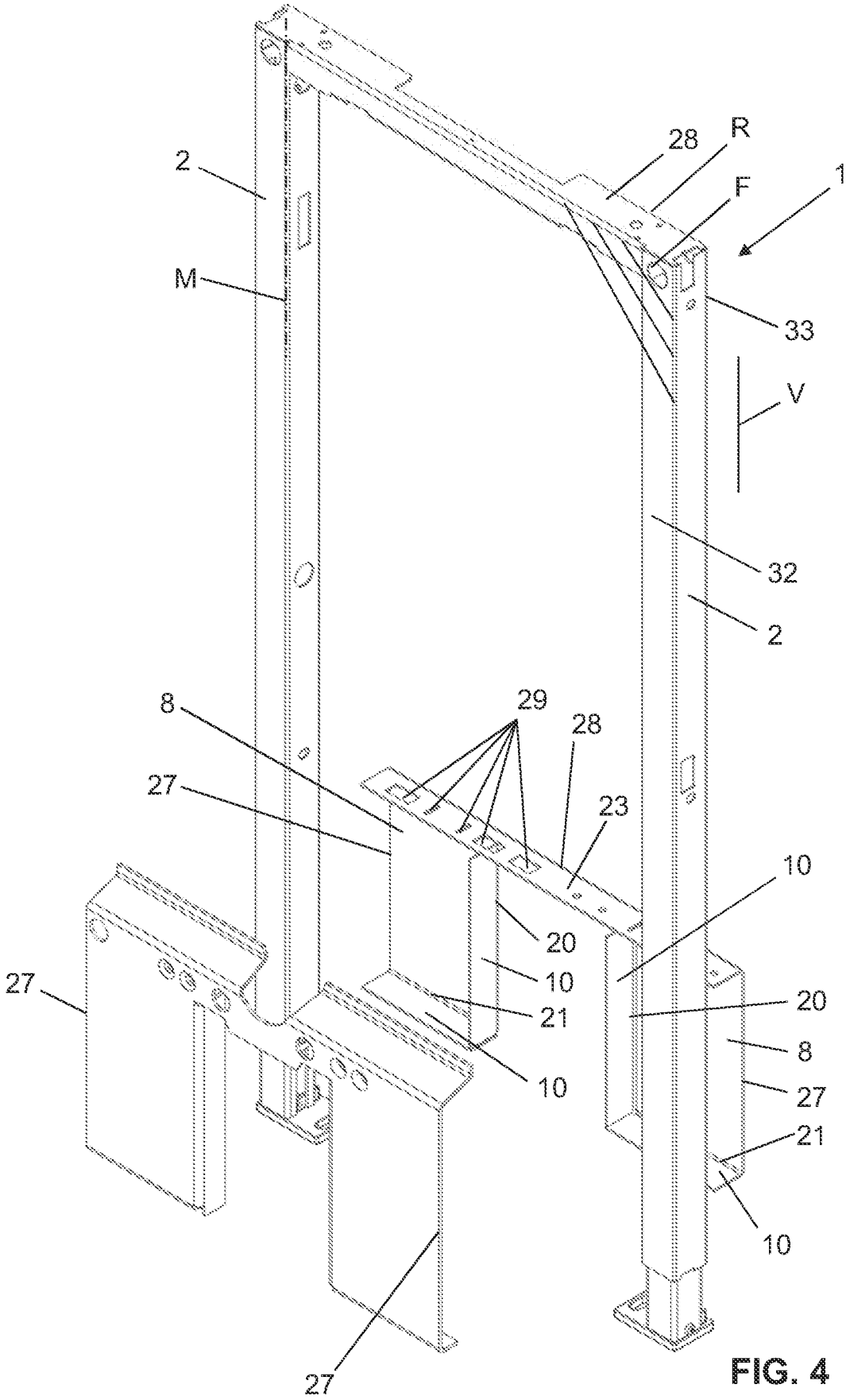
FIG. 4 shows an exploded illustration of the mounting device according to FIG. 1.

FIG. 4 now shows an exploded illustration of the mounting device 1. The crossbeam element 3 here is shown prior to actual mounting and connecting to the support 2. The crossbeam element 3 is provided by a front support part 5 having a support wall 6, and by a rear support part 7 having a rear wall 8. The sanitary item is correspondingly able to be supported on the support wall 6. In the embodiment shown, the at least one fastening element 4 lies above the support wall 6 when viewed in the installed position. This means that the at least one fastening element 4 in the case of an assembled sanitary item is stressed under tension, and that the support wall 6, or the crossbeam element 3, respectively, is stressed under compression.

The front support part 5 and the rear support part 7 in the embodiment shown have at least one connection lug 9, 10. The connection lugs 9, 10 here project orthogonally from the support wall 6, or the rear wall 8, respectively. However, the angle may also have a different dimension. The two support parts 5, 7 are integrally configured. This means that the connection lugs 9, 10 are disposed integrally on the support wall 6, or the rear wall 8, respectively.

The two support parts 5, 6 are able to be fixedly connected to one another by way of the at least one connection lug 9, 10. The connection here is of such a type that the support wall 6 in the connected state is spaced apart from the rear wall 8. Proceeding from FIG. 3, the connection is in each case performed such that the two support parts 5, 7 are moved toward one another until the two support parts 5, 6 are correspondingly positioned and can be connected by way of the at least one connection lug 9, 10.

Figure 5:
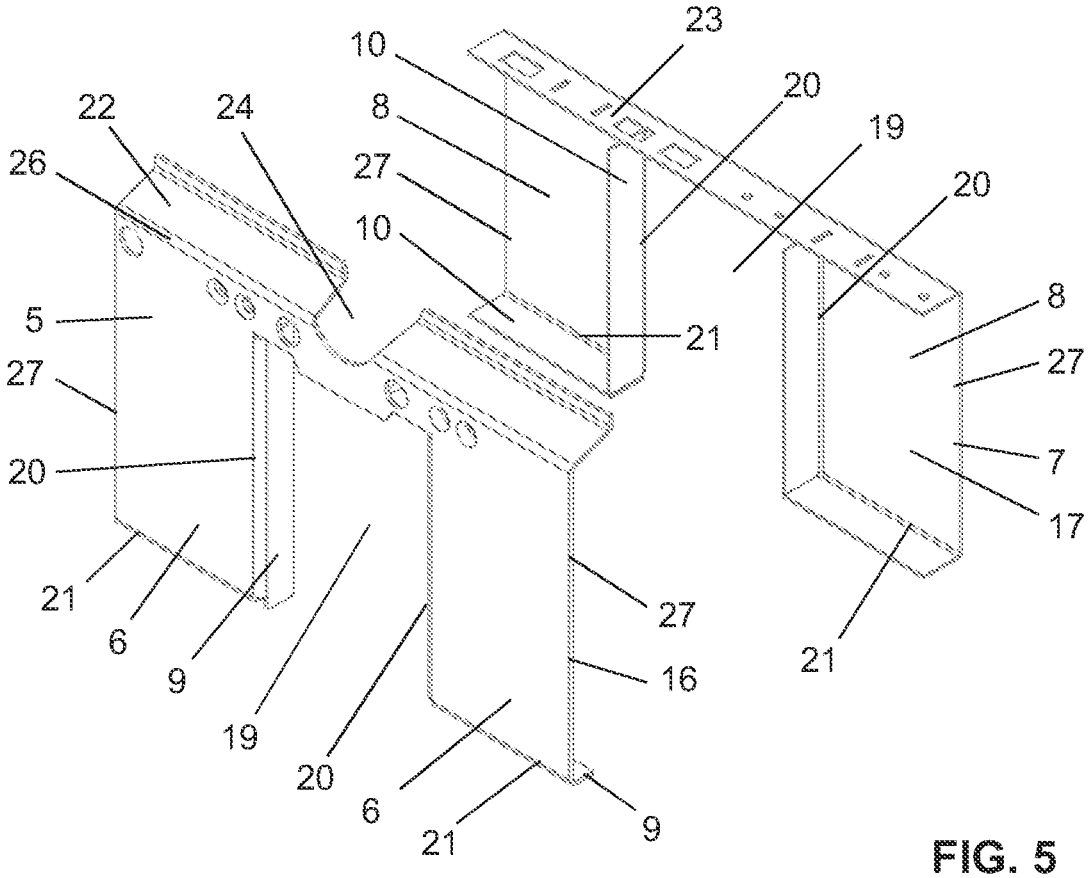
FIG. 5 shows an exploded illustration of a crossbeam element of the mounting device according to FIG. 1 from the front.
Figure 6:
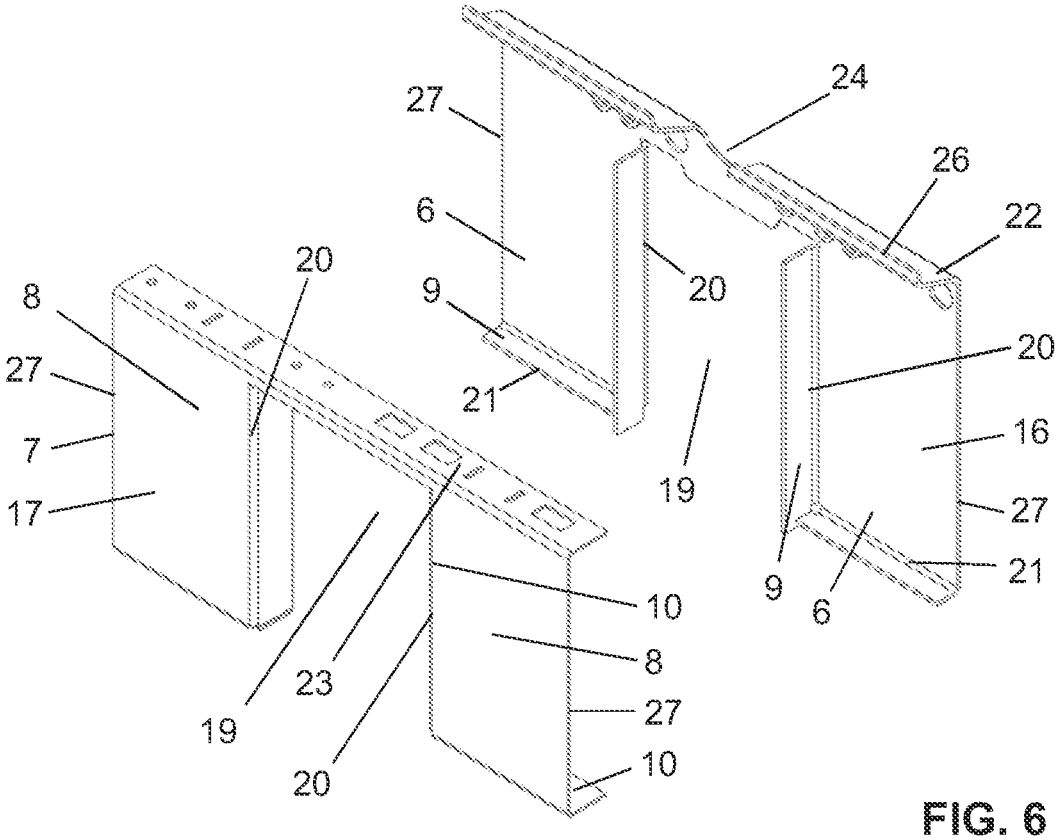
FIG. 6 shows an exploded illustration of a crossbeam element of the mounting device according to FIG. 1 from the rear.
Figure 7:
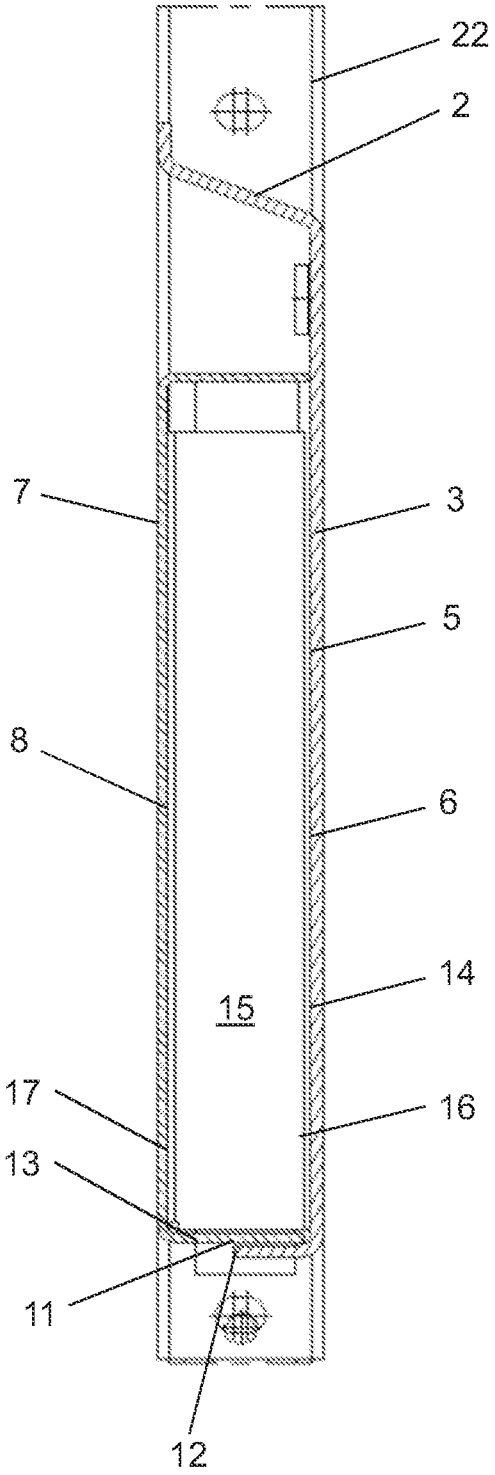
FIG. 7 shows a sectional illustration along the section line VII-VII of FIG. 3.

FIGS. 5 and 6 now show exploded illustrations of the crossbeam element 2 without the supports 2. Illustrated in each case are the front support part 5 and the rear support part 7 in isolation. FIG. 7 shows a section illustration along the section line VI of FIG. 2. Further features of the two support parts will now be explained by means of FIGS. 5 to 7.

For providing the clearance 18 mentioned, the front support part 5 has a cut-out 19 in the support wall 6. The cut-out 19 is formed by two mutually opposite lateral edges 20. One connection lug 9 projects in each case from the lateral edges 20 so as to be orthogonal to the support wall 6. One connection lug 9 which projects orthogonally to the support wall 6 is disposed in each case on lower lateral edges 21 which from the end of the lateral edge 20 at the lower end of the front support part 5 extend to the support 2. The lower lateral edge 21 in the installed position extends substantially in the horizontal. When viewed in the normal direction onto the support wall 6, the connection lugs 9 have a length. The length of the connection lugs 9 that project from the lateral edge 20 here is greater than the length of the connection lugs 9 that project from the lateral edge 21.

The front support part 4 on the upper side comprises the at least one fastening element 4. Furthermore disposed above the at least one fastening element 4 is a reinforcement portion 22 which extends along an upper lateral edge 26. The reinforcement portion 22 here runs so as to be inclined at an angle in relation to the support wall 6 and, when viewed in the installed position, extends from the fastening elements 4 rearward. The angle of the angular inclination in relation to the support wall 6 is between 90° and 145°. The reinforcement portion 22 in the embodiment shown furthermore has an interruption 24 which is provided for the feedthrough of a flushing pipe or an electrical line or any other element. In the embodiment shown, the front support part 5 in the region of the fastening elements 4 above the cut-out 19 and below the interruption 24 has a lug portion 30 which protrudes into the cut-out 19. The stability of the front support part 5 can be further increased by way of the lug portion 30.

For providing the clearance 18 mentioned, the rear support part 7 has a cut-out 19 in the rear wall 8. The cut-out 19 is formed by two mutually opposite lateral edges 20. One connection lug 10 projects in each case from the lateral edges 20 so as to be orthogonal to the support wall 6. One connection lug 10 which projects orthogonally to the rear wall 6 is in each case disposed on lower lateral edges 21 which from the end of the lateral edge 20 at the lower end of the rear support part 7 extend to the support 2. The lower lateral edge 21 in the installed position extends substantially in the horizontal. The connection lugs 10, when viewed in the normal direction onto the support wall 6, have a length. The length of the connection lugs 10 that project from the lateral edge 20 here is identical to the length of the connection lugs 10 that project from the lateral edge 21.

The rear support part 7 on the upper side comprises a reinforcement portion 23. The reinforcement portion 23 here extends away from an upper lateral edge 26 so as to be inclined at an angle, preferably substantially orthogonally. The lateral edge 26 in the installed position extends from the one support 2 to the other support 2. The reinforcement portion 23 serves for reinforcing the rear support part 7 and furthermore has openings 29 which serve for fastening sanitary items or lines or other elements.

The reinforcement portion 23 of the rear support part 7 is spaced apart from the reinforcement portion 22 of the front support part 5. An installation space 25 is achieved as a result of this spacing.

In the case of both support parts 5, 7 the connection lugs 9, 10 extend in each case substantially across the entire length of the lateral edges 20, 21.

In the connected state, the connection lugs 10 from the rear support part 7 impact the internal face 17 of the front support part 5 that faces the rear support part 7, thus defining the spacing between the front support part 5 and the rear support part 7.

In the embodiment shown, the connection lugs 9 from the front support part 5 in the region of the lower lateral edge 21 are configured so as to be shorter than the corresponding connection lugs 10 from the rear support part 7. This becomes evident from FIG. 7. As a result of this shortened configuration, the advantage is derived that a weld, in particular a weld seam, can be formed on the frontal end 12 of the connection lug 9 and the surface 13 of the connection lug 10. In FIG. 7, the weld is identified by the reference sign 11. The other connection lugs 9, 10 which are to the left and the right of the cut-out 19 are configured so as to be of identical length on both support parts.

In the connected state, the support wall 6, the rear wall 8, the connection lugs 9, 10 and the supports 2 define a hollow member 14 having a cavity 15. In other words, the crossbeam element 3 has a cavity 15. Said weld 11 preferably lies outside the cavity 15.

The two support parts 5 and 6 are preferably produced from a steel sheet; in particular by a stamping procedure and a forming procedure following the stamping procedure. The connection lugs 9, 10 are produced by a bending method during the forming procedure. The same applies for the optionally present reinforcement portions 22, 23. Once the two support parts 5, 6 are joined, the latter are typically connected to one another by welded connections. Furthermore, the crossbeam element 3, which is provided by the front support part 5 and the rear support part 7, is then connected to the supports 2. In the process, the lateral edges 27 that face the supports 2 are correspondingly welded to the supports 2.

In the embodiment shown, the mounting device 1 furthermore comprises two support feet 31 which are telescopically mounted in the support 2. The support feet 13, in terms of the position thereof relative to the support 2, can be displaced and locked at the adjusted height level.

The supports 2 in the embodiment shown are configured as hollow sections. The hollow sections here have a quadrangular, in each case a square, cross section.

The front faces 32 of the supports 2 define a front plane F, and the rear faces 33 of the supports 2 define a rear plane R. The crossbeam element 3 here is disposed in such a manner that the latter lies between the front plane F and the rear plane R. The outer support wall 6 and the rear wall 8 preferably lie in the front plane F or the rear plane R, respectively.

The weld seams mentioned herein can in each case extend across the entire length of the corresponding edge, or across partial lengths of the corresponding edge.

LIST OF REFERENCE SIGNS

1 Mounting device
2 Support
3 Crossbeam element
4 Fastening element
5 Front support part
6 Support wall
7 Rear support part
8 Rear wall
9 Connection lug
10 Connection lug
11 Weld
12 Frontal end
13 Surface
14 Hollow member
15 Cavity
16 Internal face
17 Internal face
18 Clearance
19 Cut-out
20 Lateral edge of cut-out
21 Lower lateral edge
22 Reinforcement portion
23 Reinforcement portion
24 Interruption
25 Installation space
26 Upper lateral edge
27 Lateral edge
28 Crossbeam
29 Openings
30 Lug portion
31 Support foot
32 Front face
33 Rear face
M Central axis
V Vertical
R Rear plane
F Front plane

The invention claimed is:

1. A mounting device for the fastening of at least one sanitary item, comprising two supports which run spaced apart, each support extending along a respective central axis; and a crossbeam element, which has at least one fastening element, is disposed between the supports and connects the two supports, wherein the crossbeam element comprises a front support part having a support wall configured to support a sanitary item, and a rear support part having a rear wall;

wherein the front support part and/or the rear support part have/has at least one connection lug which projects at an inclined angle from the support wall and/or from the rear wall; and wherein the front support part and the rear support part, by way of the at least one connection lug, are configured able-to be fixedly connected to one another, or are connected to one another, in such a manner that in the connected state the support wall is spaced apart from the rear wall;

wherein the support wall comprises a reinforcement portion on an upper side of the support wall in an installed position and the rear wall comprises a reinforcement portion on an upper side of the rear wall in the installed position; and wherein, in the connected state, the reinforcement portion of the support wall is spaced apart from the reinforcement portion of the rear wall such that an installation space is achieved between the reinforcement portion of the support wall and the reinforcement portion of the rear wall.

2. The mounting device as claimed in claim 1, wherein the at least one connection lug of the front support part comes into planar contact with the at least one connection lug of the rear support part.

3. The mounting device as claimed in claim 1, wherein the at least one connection lug of the one support part is shorter than the at least one connection lug of the other support part, and wherein at least one weld is on the frontal end of the shorter connection lug and the surface of the longer connection lug.

4. The mounting device as claimed in claim 1, wherein the at least one connection lug of the one support part is configured to have the same length as the at least one connection lug of the other support part, and wherein at least one weld is on the frontal end of the one connection lug and the surface of the other connection lug.

5. The mounting device as claimed in claim 4, wherein the support wall, the rear wall, the connection lugs and the supports define a hollow member having a cavity, wherein said weld lies outside the cavity.

6. The mounting device as claimed in claim 5, wherein the at least one connection lug from the front support part impacts/impact the internal face of the rear support part that faces the front support part, thus defining the spacing between the front support part and the rear support part; and/or wherein the at least one connection lug from the rear support part impacts/impact the internal face of the front support part that faces the rear support part, thus defining the spacing between the front support part and the rear support part.

7. The mounting device as claimed in claim 1, wherein the front support part is configured to be integral to the support wall and the at least one connection lug, and/or wherein the rear support part is configured to be integral to the rear wall and the at least one connection lug.

8. The mounting device as claimed in claim 1, wherein the crossbeam element comprises a clearance which provides a vacant intermediate space extending through the crossbeam element, a waste pipe being able to be routed through said intermediate space, wherein the clearance in the support parts is formed by a cut-out in the support wall and the rear wall.

9. The mounting device as claimed in claim 8, wherein connection lugs extend in each case along the lateral edges which are mutually opposite in terms of the cut-out, and wherein connection lugs extend along the lateral edges which extend from the cut-out to the support.

10. The mounting device as claimed in claim 1, wherein the connection lugs extend in each case across the entire length of that lateral edge from which said connection lugs project.

11. The mounting device as claimed in claim 1, wherein the reinforcement portion disposed on the support wall is configured as a bending lug which preferably has an optional interruption for the feedthrough of connecting lines; and/or wherein the reinforcement portion disposed on the rear wall is configured as a bending lug which preferably extends completely between the crossbeams.

12. The mounting device as claimed in claim 1, wherein the reinforcement portion disposed on the support wall is configured as a bending lug which preferably has an optional interruption for the feedthrough of connecting lines; and/or wherein the reinforcement portion disposed on the rear wall is configured as a bending lug which preferably extends completely between the crossbeams;

and wherein the reinforcement portion of the support wall in the connected state is spaced apart from the reinforcement portion of the rear wall such that an installation space is achieved between the reinforcement portions.

13. The mounting device as claimed in claim 1, wherein the support wall and the rear wall by way of the lateral edges thereof that face the support are connected to the respective support, and wherein the at least one connection lug, or the connection lugs, run along free lateral edges that are not connected to the support.

14. A method for producing a mounting device for the fastening of at least one sanitary item, said mounting device comprising two supports which run spaced apart, each support extending along a respective central axis; and a crossbeam element which has at least one fastening element, is disposed between the supports and connects the two supports, wherein the crossbeam element comprises a front support part having a support wall configured to support a sanitary item, and a rear support part having a rear wall;

wherein the front support part and/or the rear support part have/has at least one connection lug which projects at an inclined angle from the support wall and/or from the rear wall; and wherein the front support part and the rear support part, by way of the at least one connection lug, are configured to be fixedly connected to one another, or are connected to one another, in such a manner that in the connected state the support wall is spaced apart from the rear wall, wherein, in a first step, the two support parts and the two supports are provided;

wherein, in a subsequent step, the two support parts are connected to one another by the connection lugs, or the at least one connection lug, and to the supports;

wherein the support wall comprises a reinforcement portion on an upper side of the support wall in an installed position and the rear wall comprises a reinforcement portion on an upper side of the rear wall in the installed position; and wherein, in the connected state, the reinforcement portion of the support wall is spaced apart from the reinforcement portion of the rear wall such that an installation space is achieved between the reinforcement portion of the support wall and the reinforcement portion of the rear wall.

15. An arrangement comprising an mounting device and a sanitary item, said mounting device comprising:

two supports which run spaced apart, each support extending along a respective central axis; and a crossbeam element which has at least one fastening element, is disposed between the supports and connects the two supports, wherein the crossbeam element comprises a front support part having a support wall configured to support a sanitary, and a rear support part having a rear wall;

wherein the front support part and/or the rear support part have/has at least one connection lug which projects at an inclined angle from the support wall and/or from the rear wall; and wherein the front support part and the rear support part, by way of the at least one connection lug, are configured to be fixedly connected to one another, or are connected to one another, in such a manner that in the connected state the support wall is spaced apart from the rear wall, wherein the support wall comprises a reinforcement portion on an upper side of the support wall in an installed position and the rear wall comprises a reinforcement portion on an upper side of the rear wall in the installed position; and wherein, in the connected state, the reinforcement portion of the support wall is spaced apart from the reinforcement portion of the rear wall such that an installation space is achieved between the reinforcement portion of the support wall and the reinforcement portion of the rear wall, and wherein said sanitary item is assembled on the assembling device, wherein said sanitary item having a support face, and wherein the support face of the sanitary item superimposes parts of the support wall of the front support part.

16. The mounting device as claimed in claim 1, wherein the at least one connection lug projects orthogonally from the support wall and/or from the rear wall.

17. The method as claimed in claim 14, wherein the at least one connection lug projects orthogonally from the support wall and/or from the rear wall.

18. The arrangement as claimed in claim 15, wherein the at least one connection lug projects orthogonally from the support wall and/or from the rear wall.

* * * * *